US010285465B2

(12) United States Patent
Diez De Sollano Díaz

(10) Patent No.: US 10,285,465 B2
(45) Date of Patent: May 14, 2019

(54) CAP HAVING IMPERCEPTIBLE INTERNAL POCKET AND SUB-POCKET

(71) Applicant: Roberto Diez De Sollano Díaz, Mexico City (MX)

(72) Inventor: Roberto Diez De Sollano Díaz, Mexico City (MX)

( * ) Notice: Subject to any disclaimer, the term of this patent is extended or adjusted under 35 U.S.C. 154(b) by 0 days.

(21) Appl. No.: 16/064,554

(22) PCT Filed: Dec. 21, 2015

(86) PCT No.: PCT/IB2015/059816
§ 371 (c)(1),
(2) Date: Jun. 21, 2018

(87) PCT Pub. No.: WO2017/109535
PCT Pub. Date: Jun. 29, 2017

(65) Prior Publication Data

US 2019/0021429 A1 Jan. 24, 2019

(51) Int. Cl.
*A42B 1/24* (2006.01)
*A42B 1/00* (2006.01)

(52) U.S. Cl.
CPC ..... *A42B 1/241* (2013.01); *A42B 1/24* (2013.01)

(58) Field of Classification Search
CPC ..... A42B 1/241; A42B 1/24; A42B 1/002; A42B 1/004; A42B 1/069; A42B 1/205;
(Continued)

(56) References Cited

U.S. PATENT DOCUMENTS 3,070,803 A * 1/1963 Slepicka ..... A42B 1/008 2/7
3,100,896 A * 8/1963 Khanbegian ..... A42B 3/105 2/205

(Continued)

FOREIGN PATENT DOCUMENTS

GB 264779 A 12/1926
WO WO 9724039 A1 7/1997

(Continued)

OTHER PUBLICATIONS

International Preliminary Report on Patentability directed to International Patent Application No. PCT/IB2015/059816, dated Feb. 27, 2018; 15 pages.

(Continued)

*Primary Examiner* — Robert H Muromoto, Jr.
(74) *Attorney, Agent, or Firm* — Shami Messinger PLLC

(57) ABSTRACT

A cap for accommodating objects in an imperceptible manner, having elements in common with the sport-type caps, namely a visor, a body formed by a front panel and one or more rear and lateral panels, and a hatband. The cap has a pocket inside, formed by one or more internal panels, having a pocket opening, and a flap is positioned on top of the internal panels, in order to cover the pocket opening. In addition, the flap has a small sub-pocket sewn into the internal side. The space inside the pocket is delimited by the visor, the front panel, the internal panels and the hatband. In this way, the pocket can store, inter alia, spectacles, keys, cigarettes and lighters, while the sub-pocket can store, inter alia, coins, notes and cards.

21 Claims, 4 Drawing Sheets

(58) Field of Classification Search
CPC ... A42B 3/10; A42C 1/00; Y10S 2/918; Y10S 2/11; Y10S 2/906; A41D 27/08; A41D 27/20; A41D 2400/48; A45F 5/022
See application file for complete search history.

(56) References Cited

U.S. PATENT DOCUMENTS 3,268,911 A * 8/1966 Cox ..... A42B 3/14 2/181.4
4,091,469 A * 5/1978 Davidson ..... A42B 3/105 2/410
4,138,744 A * 2/1979 Pitzel ..... A41D 15/04 2/171
4,165,542 A * 8/1979 McLaughlin ..... A42B 1/241 2/175.1
4,312,076 A * 1/1982 Gamm ..... A42B 1/241 2/195.2
4,386,437 A * 6/1983 Fosher ..... A42B 1/241 2/10
4,484,363 A * 11/1984 Varanese ..... A42B 1/008 2/181
4,776,042 A * 10/1988 Hanson ..... A42B 1/008 2/171
5,070,545 A * 12/1991 Tapia ..... A42B 1/064 2/10
5,233,703 A * 8/1993 Galka ..... A42B 1/248 2/10
5,327,585 A * 7/1994 Karlan ..... A42B 1/008 2/171.2
5,395,400 A * 3/1995 Stafford ..... A42B 1/008 2/209
5,539,929 A * 7/1996 Revson ..... A42B 1/241 2/175.1
5,548,847 A * 8/1996 Spicijaric ..... A42B 1/248 2/181
5,581,813 A * 12/1996 Henschel ..... A42B 1/248 2/195.1
5,605,144 A * 2/1997 Simmons ..... A41D 13/0051 126/204
5,647,064 A * 7/1997 Whittaker ..... A42B 1/002 2/175.4
5,685,017 A * 11/1997 Kraft ..... A42B 1/067 2/10
5,704,070 A * 1/1998 Stogner ..... A42B 1/241 2/175.1
5,724,678 A * 3/1998 McCallum ..... A42B 1/241 2/181
5,933,871 A * 8/1999 Kraft ..... A42B 1/067 2/181.4
6,185,750 B1 * 2/2001 Dumas ..... A41D 13/0055 2/171.2
6,237,154 B1 * 5/2001 Reuven ..... A42B 1/008 2/171.2
6,317,892 B1 * 11/2001 Galigani ..... A42B 1/201 2/209.11
6,557,179 B1 * 5/2003 Reuven ..... A42B 1/008 2/171.2
7,761,933 B2 * 7/2010 Pham ..... A42C 1/00 2/410
9,993,042 B1 * 6/2018 Miller ..... A42B 1/041
2001/0004773 A1 * 6/2001 Moore ..... A42B 3/003 2/425
2005/0246825 A1 * 11/2005 Ruhl ..... A42B 1/18 2/422
2008/0184457 A1 * 8/2008 Pham ..... A42C 1/00 2/209.13
2012/0060259 A1 * 3/2012 Falken ..... A42B 1/241 2/209.13
2013/0037431 A1 * 2/2013 Lin ..... A45F 4/12 206/278
2017/0042270 A1 * 2/2017 Chiang ..... A42B 1/245
2017/0251741 A1 * 9/2017 Wang ..... A42B 1/245
2018/0049493 A1 * 2/2018 Graves ..... A41D 27/20
2018/0289133 A1 * 10/2018 Zhijian ..... A45C 15/00
2019/0021429 A1 * 1/2019 Diez De Sollano Diaz ..... A42B 1/24

FOREIGN PATENT DOCUMENTS

WO WO 2005/079176 A2 9/2005
WO WO 2017/109535 A1 6/2017

OTHER PUBLICATIONS

English-language translation of International Preliminary Report on Patentability directed to International Patent Application No. PCT/IB2015/059816; 3 pages.
International Search Report and Written Opinion directed to International Patent Application No. PCT/IB2015/059816, dated Mar. 31, 2016; 8 pages.
English-language translation of International Search Report and Written Opinion directed to International Patent Application No. PCT/IB2015/059816; 8 pages.

* cited by examiner

CAP HAVING IMPERCEPTIBLE INTERNAL POCKET AND SUB-POCKET

TECHNICAL FIELD

This invention is related with the technological field of clothing textiles. Particularly, this invention consists with a new cap having an internal pocket and sub-pocket which cannot be seen by others.

BACKGROUND

Nowadays, there is a great concern to safely store valuable objects during days and wanderings; thus, it requires to be indiscernible to others. A wearable or clothing often used is a sports cap. Thus, it would be convenient if such wearable could have the capacity to safely store objects.

In connection thereof, in the technical field there are several patent and design documents seeking to address such need. For example, the U.S. Pat. No. 5,539,929 dated Jul. 30, 1996 (REVSON) describes a cap having a head covering portion and a compartment on the exterior of the headcover portion aligned with a lower edge thereof to store objects. This cap also has a zipper or other sealing device is provided for the compartment. In a preferred embodiment, the sealing device is located on an overlying layer to the head covering portion, the periphery of which is sealed to the head covering portion to define the compartment. This invention has a disadvantage consistent in the fact that the compartment for storing objects is at the exterior of the cap; thus, everyone can see the compartment. In addition, another disadvantage of that invention is that the zone where the compartment is located in the head covering portion constitutes an uncomfortable zone for the wearer inasmuch the wearer would have the objects inside the compartment placed against the wearer's head and, even, the objects could be damaged for that. Finally, another disadvantage is that the documents foresees a sole compartment where the stored objects cannot be separated.

On other hand, the U.S. Pat. No. 5,724,678 dated Mar. 10, 1998 (McCallum et al), describes a hat or cap having a storage pocket on the inside of the hat which is located entirely within a dead space at the front portion of the hat extending from a location spaced above a hat band towards the crown or top of the hat. In such invention, when a hat is worn, there will be a dead space inside the hat where the hat does not contact the wearer's head, which typically extends from a location just above the hat band to the crown of the hat, due to the difference in curvature between the wearer's head and the hat itself.

By positioning a storage pocket in this area, unsightly bulges are avoided, as well as discomfort due to stored items pressing against the wearer's head. This patent document has as disadvantage that the storage pocket is opened backwards (de cabeza), thus, it could open due to the weight of the articles contained thereat. In addition, another disadvantage of that invention is that the zone where it is located is insufficient for supporting the weight of several articles; therefore, that hat zone would collapse and would make it visible the existence of the articles stored in the pocket. Finally, another disadvantage is that the documents foresees a sole compartment where the stored objects cannot be separated.

Other documents of the previous art describing caps or hats with internal pockets are the following: the United Kingdom patent UK 644,779 dated Dec. 29, 1926; the international publication WO 97/24039 dated Jul. 10, 1997; the international publication WO 2005/079176 dated Sep. 1, 2005, and the US application request US 2012/0060259 dated Mar. 15, 2012. It is relevant to state that none of the foregoing documents establishes that the pocket (storage) has a sub-pocket.

Thus, there is the need of a cap having an internal pocket and sub-pocket to store articles, in a manner serving to store different articles. Likewise, there is a need for both, the internal pocket and sub-pocket of the cap to be imperceptible through an adequate structural support to support the weight of the stored articles. Moreover, there is a need for the cap to continue providing comfort to its wearer and to refrain being uncomfortable for the wearer when storing objects in its interior. Finally, a sports cap storing objects still when the wearer takes off the cap placing it over a surface or in a coat rack, without having the risk of dropping the objects and being perceptible to others, is also needed.

OVERVIEW

The main objective of this invention is to provide an improved cap having an internal pocket to store objects.

Another objective of this invention is to provide a cap which, additionally, has a sub-pocket in the internal pocket to store different objects.

Another objective of this invention consists in the fact that the internal pocket and sub-pocket of the cap, are imperceptible to others.

Further, another objective of this invention is that the pocket of the cap may adequately support the weight of the stored objects in order to maintain its imperceptible feature.

Another objective of this invention is that such cap with pocket and sub-pocket is fabricated in one piece which facilitates its manufacturing.

Another objective of this invention is that the cap grants security to the wearer to store his/her objects without being noticeable that he/she carries them, or which could be dropped-off and, thus the wearer may have his/her hands free.

Another objective of this invention refers to the fact that the cap is comfortable inasmuch the stored objects do not cause inconvenience to the wearer.

Finally, another objective of this invention is that the cap provides designs, colors, fabrics, and other options, so it is stays fashionable.

BRIEF DESCRIPTION OF THE DRAWINGS

To provide a better understanding of the invention, the following drawings are attached.

DESCRIPTION OF EXAMPLE EMBODIMENTS

This invention hereby described pursuant to a preferred modality, constitutes a cap having imperceptible pocket and sub-pocket as shown in the figures attached to this description.

Figure 1:
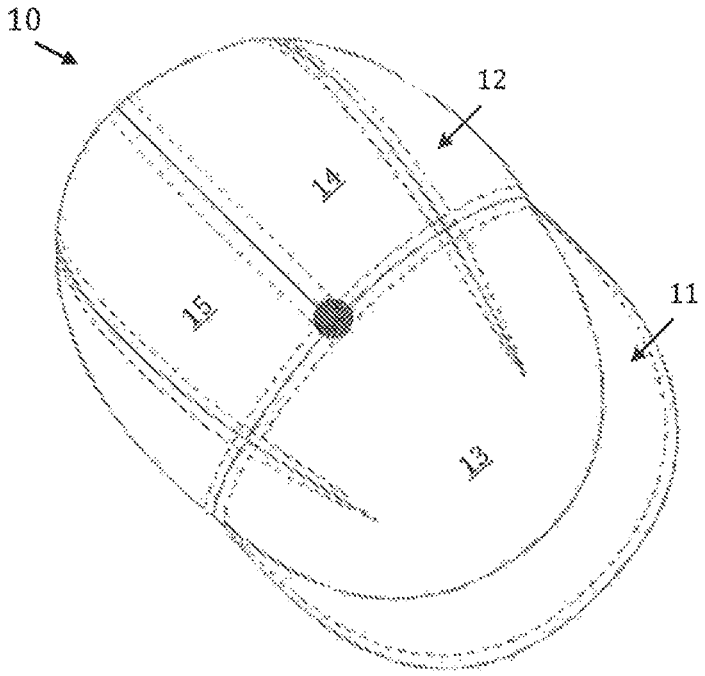
FIG. 1 refers to a view from the top of the cap with imperceptibles internal pocket and sub-pocket pursuant to this invention.
Figure 2:
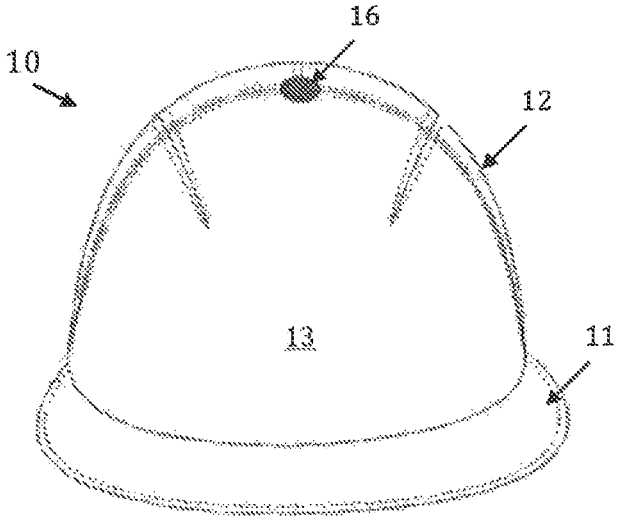
FIG. 2 refers to a frontal view of the cap with imperceptibles internal pocket and sub-pocket pursuant to this invention.
Figure 3:
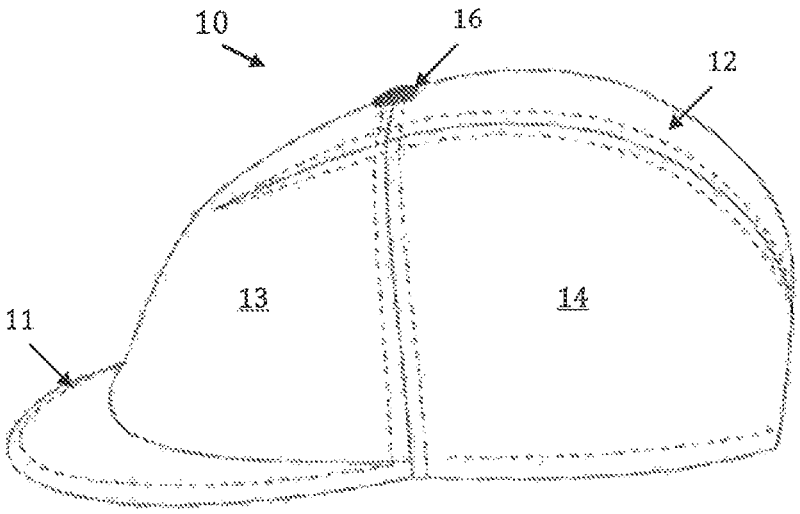
FIG. 3 refers to a lateral view of the cap with imperceptibles internal pocket and sub-pocket pursuant to this invention.

With reference to FIGS. 1 through 3, the invention consists in a cap (10) with common semblance, as the known caps, having a visor (11) and a cap body (12). The cap body (12) allows to use the space for a substantial spherical body, such as the superior portion of the human head of a wearer.

Preferably, the body (12) has a frontal panel (13) and two lateral rear panels (14) and (15) joined by seams or similar mechanisms. At the upper part of the steam union, the cap body also has a central button (16). Notwithstanding the foregoing, the cap confection (10) may comprehend one or several unions of material panels by steams or several similar unions, or well, any kind of clothing allowing to store the upper portion of the wearer head.

In the modality shown, additional ornamental seams or elements are also shown, which go through one to other panels of the cap body (12).

Figure 4A:
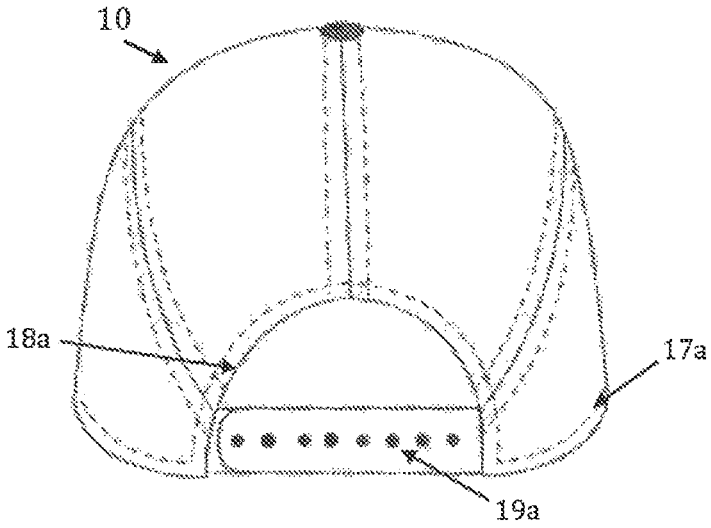
FIG. 4 refers to a rear view of the cap with imperceptibles internal pocket and sub-pocket pursuant to this invention, in a first modality.
FIG. 4B refers to a rear view of the cap with imperceptibles internal pocket and sub-pocket pursuant to this invention, in a second modality.
Figure 4B:
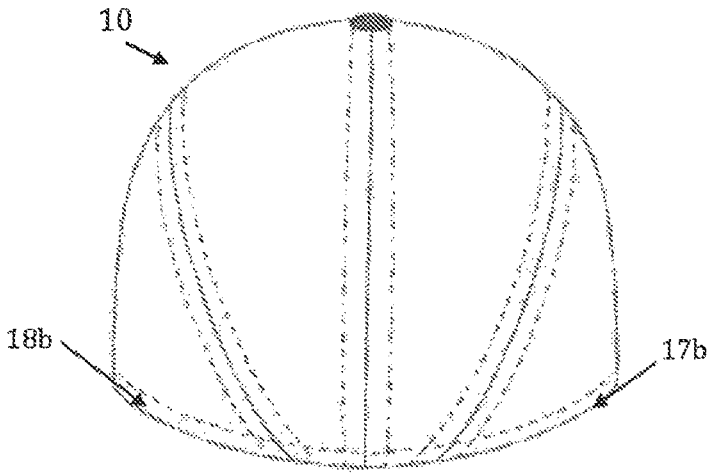

The FIGS. 4A and 4B show a first and second modality, respectively. In FIG. 4A the first modality having a snood (17*a*), a rear opening (18*a*), and a closing mechanism (19*a*) is shown. Preferably, the snood (17*a*) is made from fabrics which purpose is to provide support and structure to the periphery of the cap which is placed around the wearer's head. Preferably, the rear opening (18*a*) is a mid-circle at the bottom rear part and in both of its end edges, the closing mechanisms (19*a*) are placed, which can be two plastic tabs or tabs of similar material, which are coincidentally joined. FIG. 4B shows the second modality having a snood (17*a*), which has an elastic piece in its interior (18*b*). Preferably, the snood (17*a*) is made from fabrics which purpose is to provide support and structure to the periphery of the cap which is placed around the wearer's head.

Preferably, the elastic piece (18*b*) is a spring or a similar material which is located in that snood (17*b*) to support the cap.

Figure 5:
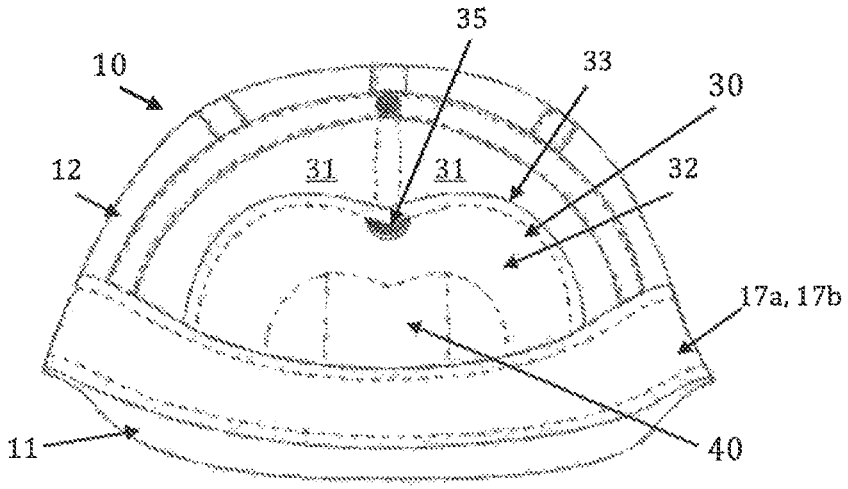
FIG. 5 refers to a cross-sectional view of the cap with imperceptibles internal pocket and sub-pocket pursuant to this invention.
Figure 6A:
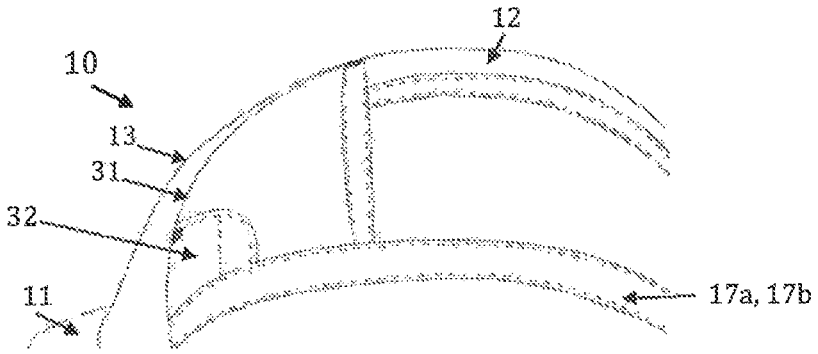
FIG. 6A refers to a long-axis view of the cap with imperceptibles internal pocket and sub-pocket pursuant to this invention.
Figure 6B:
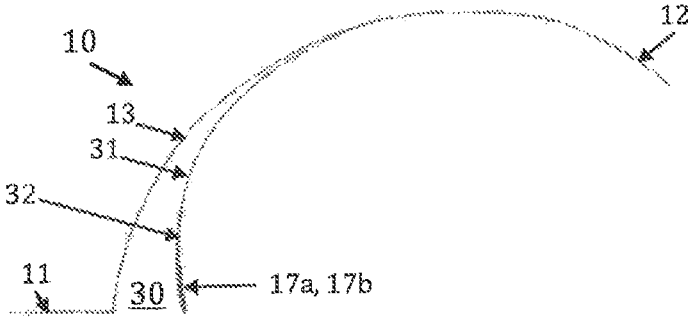
FIG. 6B refers to a plain (sin fondo) long-axis view of the cap with imperceptibles internal pocket and sub-pocket pursuant to this invention.
Figure 7:
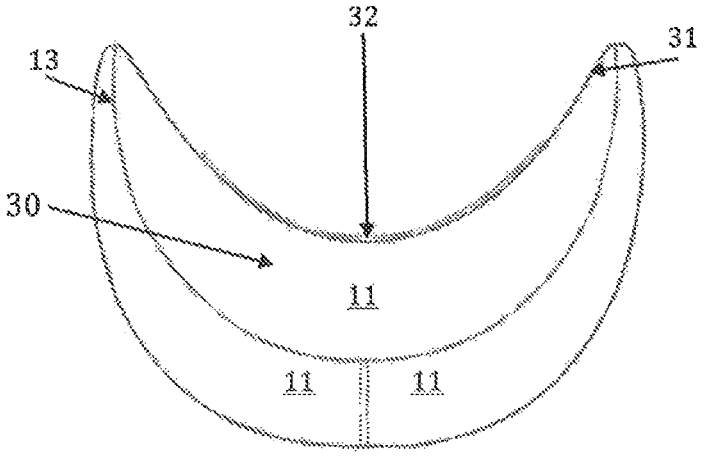
FIG. 7 refers to a plan view of the cap with imperceptibles internal pocket and sub-pocket pursuant to this invention, in a second modality.

The essential elements of this cap invention are shown in FIG. 5, which correspond to a cross-sectional view in the interior of the cap (10). As may be observed from the cap's interior point of view (10), a pocket (30) is constituted by two internal panels. Preferably, the pocket (30) is constituted by two alike internal panels (31) joining to form the pocket wall (30) facing the interior of the cap (10). The internal panels have a cap opening. A gate (32) is constituted by a piece which is wider than the internal panels (31) and is on top of the former to cover the pocket opening. The gate (32) is delimited in its bottom portion by the snood (17*a*, 17*b*), and in its upper part by an edge (33) over which the supporter (35) is located. Preferably, the supporter (35) is formed by a fabric slant sewed in different forms, e.g., in a triangular shape. The supporter (35) serves to pull out the gate (32) in order to have access to the pocket (30) of the cap (10). Preferably, the gate (32) is produced with a structured fabric which, when releasing it, it automatically comes back. FIGS. 6A, 6B, and 7 show different views showing the interior space of the pocket (30) to provide a better perspective of the space of the pocket (30). The space of the pocket (30) is delimited by the visor (11), the panel (13), the panels (31), and the snood (17*a*, 17*b*). Moreover, the gate (32) in its interior has a small sub-pocked sewed in it (40) shown in segmented line from the interior perspective of FIG. 5. The objects stored in the pocket (30) are supported over the visor portion (11) which is between the panels (13) and (31) which provides support to the weight of such objects, making them more imperceptible to the exterior of the cap (10). The objects stored in the sub-pocket (40) are reclined in the internal portion of the gate (32) but specially comprehend the same space in the pocket (30). Preferably, the gate (30) may store glasses, keys, cigars, igniters; inasmuch the sub-pocket (40) may store, among others, coins, bills, and cards. It should be noted that, even if the cap is not being used over the wearer's head, e.g. if the wearer has it in his/her hands, or if it is placed over a surface or a coat rack, the objects stored in the interior of the pocket and the sub-pocket are kept inside and keeping an imperceptible semblance.

This invention has been defined in respect to a sports cap, but it can contain within its scope, the necessary adjustments for being used in different clothing, such as: balmoral, barretina, biretta, cap, beret, capirote, academic cap, shako, chullo, colbac, durag, raccoon cap, cap Ascot, Ávila cap, baseball cap, field cap, chilote cap, cricket cap, nurse cap or tiara, Juliet cap, Iceland cap, sailor cap, hat cap, Gatsby cap, military cap, student cap, flat cap, trucker cap, tuque, phrygian cap, chef hat, kippa, kofia, kolpik, kufi, pakul, papaja, peci or songkok, quepis, salacot, skullcap, German cap, and hats.

Based upon the previous disclosure, certain modalities and details have been described with the purpose of illustrating this invention, and it will evident to the subject experts that variations and modifications can be made without deviating from the scope of this invention.

What is claimed is:

1. A cap to store objects in an imperceptible manner comprising:

a visor;

a body formed by a frontal panel and one or more lateral rear panels;

a snood;

a pocket created by one or more internal panels having a pocket opening;

a gate on top of the internal panels to cover the pocket opening;

small sub-pocket sewed on interior side of the gate, wherein the interior space of the pocket is delimited by the visor, the frontal panel, the internal panel, and the snood, and wherein the gate on its interior side has a small sub-pocket sewed.

2. The cap of claim 1, where the cap body allows to allocate the space for the upper portion of the wearer's human head.

3. The cap of claim 1, where the panels forming the body are joined by seams or similar joining means.

4. The cap of claim 1, where the cap is formed by two rear lateral panels.

5. The cap of claim 1, where the upper point of the body cap has a central button.

6. The cap of claim 1, where the body also has decorative elements or seams which go through one or more panels.

7. The cap of claim 1, where the snood is made out of fabric to provide support and structure to the cap's periphery placed around the wearer's head.

8. The cap of claim 1, where the rear part of the body has an opening rear and a closing mechanism.

9. The cap of claim 8, where the rear opening is a mid-circle in the bottom rear part and where the closing mechanisms are in both of their edges.

10. The cap of claim 8, where the closing mechanisms may be two plastic tabs or tabs of similar material, which are coincidentally joined.

11. The cap of claim 1, where the snood has an elastic piece in its interior.

12. The cap of claim 11, where the elastic mean is a spring or a similar article.

13. The cap of claim 1, where the cap comprehends two alike internal panels joining together.

14. The cap of claim 1, where the gate is wider than the internal panels.

15. The cap of claim 1, where the gate is delimited in its bottom part by the snood and in its upper part by an edge over which a supporter is placed.

16. The cap of claim 15, where the supporter is formed by a fabric slant sewed in different forms.

17. The cap of claim 16, where the fabric slant has a triangular shape.

18. The cap of claim 1, where the objects stored in the pocket are supported over the portion of the visor between the frontal panel and the internal panels.

19. The cap of claim 1, where the objects stored in the sub-pocket are reclined in the internal portion of the gate but specially comprehend the same space in the pocket.

20. The cap of claim 1, where the cap may store, inter alia, glasses, keys, cigars, and igniters.

21. The cap of claim 1, where the sub-pocket allows to store, inter alia, coins, bills, and cards.

* * * * *